US005135259A

United States Patent [19]

Garza

[11] Patent Number: 5,135,259

[45] Date of Patent: * Aug. 4, 1992

[54] NOTEPAD FOR CHECKBOOKS

[76] Inventor: Raul G. Garza, 12 Ollerton, Conroe, Tex. 77303

[ * ] Notice: The portion of the term of this patent subsequent to Mar. 27, 2007 has been disclaimed.

[21] Appl. No.: 684,218

[22] Filed: Apr. 12, 1991

[51] Int. Cl.[5] ..... B42D 3/00

[52] U.S. Cl. ..... 281/29; 281/15.1; 283/58; 283/64.1

[58] Field of Search ..... 281/15.1, 2, 5, 29, 281/31, 35, 37; 283/58, 64.1; 434/410

[56] References Cited

U.S. PATENT DOCUMENTS 4,422,672 12/1983 Levi ..... 281/15.1
4,744,161 5/1988 Instance ..... 281/5
4,822,074 4/1989 Hueffman et al. ..... 281/2 X
4,995,641 2/1991 Landry et al. ..... 281/15.1

*Primary Examiner*—Timothy V. Eley
*Assistant Examiner*—Willmon Fridie, Jr.
*Attorney, Agent, or Firm*—Harrison & Egbert

[57] ABSTRACT

A notepad including a plurality of sheets affixed together along a common edge, a backing surface connected to the plurality of sheets, and an adhesive strip fastened to the backing surface. The backing surface has a front side and a back side. The plurality of sheets are aligned along the front side of the backing surface. The adhesive strip has an adhesive surface on one side opposite the backing surface. This adhesive surface has an adhesive strength of between five ounces per inch of width and eighty-five ounces per inch of width. A second adhesive strip is also fastened to the backing surface and has an adhesive strength equal to that of the first adhesive strip. The adhesive surface is fastened to a flexible foldable cover of a polyvinyl chloride material having plasticizers contained therein.

20 Claims, 2 Drawing Sheets

NOTEPAD FOR CHECKBOOKS

TECHNICAL FIELD

The present invention relates to checkbooks. More particularly, the present invention relates to checkbooks having a writing area contained therein.

BACKGROUND ART

In present checkbooks and appointment books [such as DAYTIMERS (TM)], it is often difficult to carry out computations, record information, and otherwise balance the checkbook without having an adjacent sheet of paper. Many times, checkbook users must conduct mathematical computations in the margins surrounding the checks, or in the ledger portion of checkbooks. Beyond the unsightly appearance of such margin calculations, these additional markings can create problems for banks and other persons that would process such checks. The appearance of these unsightly calculations within the ledger sheet could confuse the user and cause miscalculations in balancing one's checkbook.

Many present day checkbooks incorporate a calculator within the checkbook cover. Although this aids in the computation of various matters associated with checking activities, calculators are cumbersome and will not record a variety of information. In addition, calculators cannot be easily folded or stuffed into one's pocket haphazardly. Many times, calculators will run out of power, or will become defective with continued use. The use of circulators in conjunction with checkbooks is a costly endeavor by the checkbook manufacturer and is generally found to be unsuitable for consumer use.

A magic slate was developed by the present inventor which fastens to the interior of a checkbook. This invention was patented as U.S. Pat. No. 4,911,476 on Mar. 27, 1990. This information pad for checkbooks included a checkbook cover having a flexible material and an information receiving pad that was flexibly fastened to an edge of the checkbook cover. The checkbook cover is a type that has a suitable slot for receiving checkbooks. The information pad has an area that is less than the area of the checkbook cover. The information receiving pad included an impression layer, a flexible translucent adhering sheet, a flexible transparent sheet, and a slip coating. A hinge member extended between the edge of the impression layer and the edge of the checkbook cover so as to allow the information receiving pad to be folded within the cover.

After experimentation, it was found that most checkbook covers are made of polyvinyl chloride. Additionally, plasticizers and other chemicals are incorporated into the polyvinyl chloride of the checkbook covers so as to make the checkbook cover soft and flexible. These plasticizers are very effective in simulating the feel and quality of leather. However, when plasticizers are used in the formation of the checkbook cover, it becomes very difficult to apply adhesives to the checkbook cover. Generally adhesive tape will not stick to the checkbook cover. If it does stick, then it would not withstand the loads placed upon it. If adhesives of great strength are used, then such adhesives make it impossible to remove the pad and also cause the paper to tear. It is extremely important to have the proper balance of adhesive strength versus the material that is used in the notepad.

It is virtually impossible to obtain a notepad that can fasten to a checkbook cover or to an appointment book cover. Typical, "POST-IT (TM)" pads are unsuitable for affixing to the plasticized covers. The adhesive strength in the "POST-IT (TM)" pads is less than three ounces per inch of width. Although the "POST-IT (TM)" pads stick, for a very short period of time, to the cover, they do not withstand the loads placed upon it. In a very short time, the "POST-IT" pad will no longer adhere to the checkbook cover. No other notepads having adhesives of greater strength, are available for this purpose.

It is an object of the present invention to provide a notepad for checkbooks and appointment books.

It is another object of the present invention to provide a notepad that can be adhesively fastened to a foldable plasticized cover.

It is another object of the present invention to provide a notepad that can be removed and replaced from the cover as needed.

These and other objects and advantages of the present invention will become apparent from a reading of the attached specification and appended claims.

SUMMARY OF THE INVENTION

The present invention is a notepad for checkbook that comprises a plurality of sheets affixed together along a common edge, a backing surface connected to the plurality of sheets, and an adhesive strip fastened to the backing surface. As used herein, the term "checkbook cover" refers to foldable plasticized covers for checkbooks, appointment books and the like. The backing surface has a front side and a back side. The plurality of sheets are arranged against the front side of the backing surface. The adhesive strip has an adhesive surface on the side opposite the backing surface. This adhesive surface has an adhesive strength of between five ounces per inch of width and eight-five ounces per inch of width, in accordance with D3330 ASTM peel adhesion test ratings for adhesives subjected to a 180° peel test.

The checkbook cover is made of a polyvinyl chloride material having plasticizers contained therein. The backing surface has a size less than half of the area of the checkbook cover. The checkbook cover is foldable over the entire exterior surface of the plurality of sheets.

Each of the plurality of sheets has a size of approximately 7 inches by 3 ¼ inches (or roughly twenty-two square inches). The adhesive strip extends longitudinally along the back surface. A second adhesive strip is fastened to another location on the backing surface. The second adhesive strip has an adhesive strength equal to that of the first adhesive strip. This second adhesive strip extends parallel to the first adhesive strip and extends longitudinally along t he backing surface. Ideally, the adhesive strength of the adhesive surface of the adhesive strip is twelve ounces per inch of width.

A silicon-based paper strip is provided on the adhesive surface of the adhesive strip. This paper strip is removably attached to the surface. The liner may be removed prior to attachment to a checkbook cover.

DETAILED DESCRIPTION OF THE INVENTION

Figure 1:
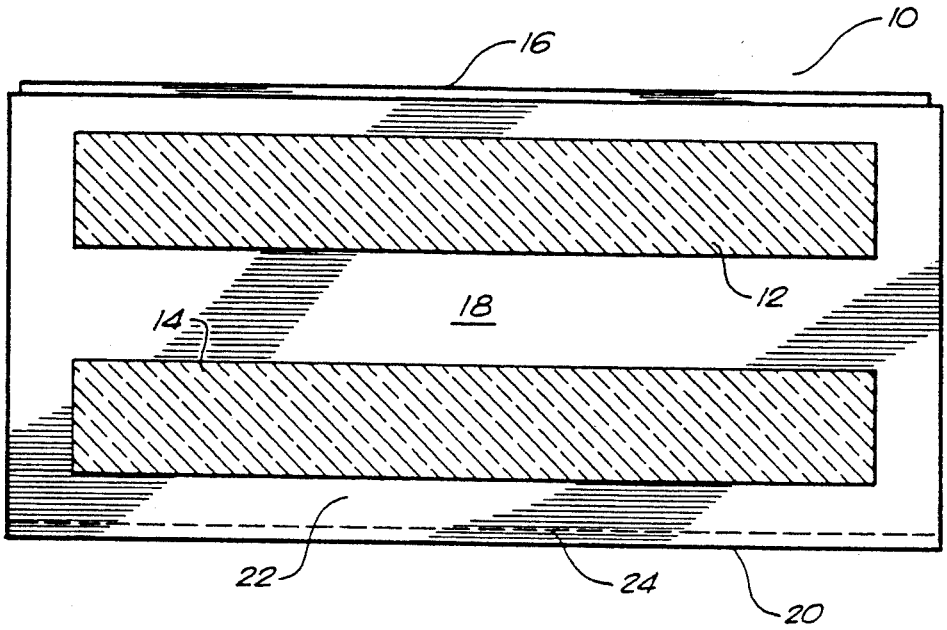
FIG. 1 is a view, in side elevation, of the notepad for checkbooks in accordance with the preferred embodiment of the present invention.

Referring to FIGURE 1, there is shown at 10 the notepad for checkbooks in accordance with the preferred embodiment of the present invention. Notepad 10 comprises a first adhesive strip 12, a second adhesive strip 14, a plurality of sheets 16, and a backing surface 18. The plurality of sheets 16 are affixed together along a common edge 20. Each of the plurality of sheets has a size of 7 inches by 3 ¼ inches (or roughly twenty-two square inches). The backing surface 18 is connected to this plurality of sheets 16. The backing surface 18 has a front side and a back side. The back side 22 is illustrated in FIG. 1. The plurality of sheets 16 are positioned adjacent to the front side of the backing surface.

Adhesive strip 12 is fastened to the back side 22 of backing surface 18. The adhesive strip 12 includes an adhesive surface on the side opposite to the backing surface 18. The adhesive strip 12 has an adhesive strength of between five ounces per inch of width and eighty-five ounces per inch of width, based upon an D3330 ASTM peel adhesion test rating for a 180° peel test.

A second adhesive strip 14 is also fastened in another location to the backing surface 18. The second adhesive strip 14 has an adhesive strength that is equal to that of the first adhesive strip 12. The second adhesive strip 14 is arranged in parallel relationship with the first adhesive strip. Both the first adhesive strip 12 and the second adhesive strip 14 extend longitudinally across the backing surface 18. Each of the adhesive strips 12 and 14 are adhesively fastened to the back side 22 of backing surface 18.

Figure 2:
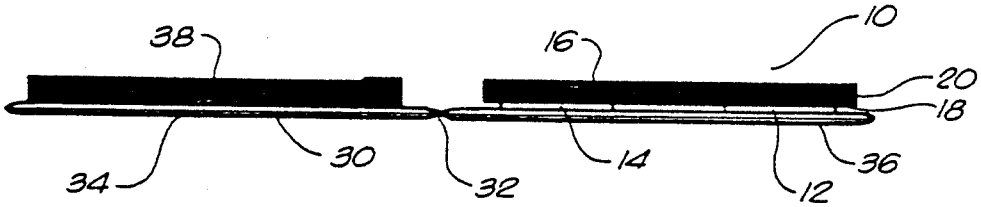
FIG. 2 is a side view showing an open checkbook cover with the notepad attached in its desired position.

FIG. 2 illustrates the configuration of the notepad 10 as fastened to a checkbook cover 30. As used herein, the term "checkbook cover" refers to actual checkbook covers, to appointment book covers, and to similar foldable flexible plasticized covers. Checkbook cover 30 has a generally flat configuration. The checkbook cover 30 narrows at hinge point 32 such that the first second 34 of checkbook cover 30 and the second section 36 of checkbook cover 30 can fold over onto one another. The checkbook cover 30 is generally composed of a plasticized material. In particular, the checkbook cover 30 is made of polyvinyl chloride material having plasticizers contained therein.

Typically, liquids are added in quantity as plasticizers to economize, improve processability, soften, or improve low-temperature performance of organic compounds. A soft (thirty to forty durometer) polychlororene (neoprene) compound, because of its high softening-oil content, will be expected to be much more difficult to bond than harder stocks. A polychloroprene stock plasticized to pass a −67° F. brittleness test will be expected to be much more difficult to bond than an unplasticized stock. Similarly, if the harder, or "unplasticized" stocks have been extended by high aromatic-oil loading to reduce costs, the bonding may also be seriously and negatively affected.

Besides curing systems fillers and plasticizers a compound used in the checkbook cover may contain protective chemicals such as antioxidants, antiozonants, waxes, and fungicides. Some of these are designed to migrate to the surface of the compound and form a protective layer or "bloom". Other compounding ingredients may unintentionally bloom sulphur from the cure system, for example. Liquids and solids in elastomers form liquid-liquid or solid-liquid (rubber is considered a liquid) systems which may easily become saturated. In such cases, excess compounding ingredients will also migrate to the surface. It is not hard to ascribe effects on adhesion and surface preparation prior to adhesion to such blooming conditions.

As such, the checkbook cover 30 contains these plasticizers, and other ingredients, that makes adhesion, by adhesives, quite difficult.

Also, in FIG. 2, there is shown the notepad 10 as affixed to adhesive strips 12 and 14 to the second section 36 of checkbook cover 30. It can be seen that the backing surface 18 includes a plurality of sheets 16 fastened along the common edge 20. The checkbook 38 is fastened to the first section 34 of checkbook cover 30. Typically, the checkbook 38 will have its back cover slidably positioned within a slot formed on the inside of the checkbook cover 30.

Each of the adhesive strips 12 and 14 are "pressure-sensitive adhesives". The term "pressure-sensitive adhesive" refers to that type of adhesive which, when in a dry state, will adhere to a variety of surfaces merely by the application of light hand pressure. Such compositions are inherently soft, permanently tacky materials which exhibit a balance of adhesive and cohesive strength depending on the viscoelastic nature of the adhesive and the performance requirements of the particular end use. When applied to the inner surface of a checkbook cover, it is important to the performance of the present invention that the peel adhesion be such as to allow the notepad 10 to be positioned in a fixed manner to the checkbook cover while, at the same time, allowing the notepad to be removed without leaving residual material on the interior of the cover 10. In accordance with D3330 STM peel adhesion test standards, peel adhesion is determined by measuring the force required to remove a pressure-sensitive material by peeling at a constant rate, usually at an angle of 180° F. to the substrate. In addition to the viscoelastic properties of the adhesive, other factors affecting peel adhesion are polarity of the adhesive, thickness of the bond, temperature, the length of time that the adhesive has been in contact with the surface, rate of removal, and the nature of both the substrate and the backing material. In experiments with the present invention, it has been found that the optimal performance of the adhesive strips 12 and 14 are when the adhesive surface of these strips has an adhesive strength of between five ounces per inch of width and eighty-five ounces per inch of width. The preferred embodiment is fifteen ounces per inch of width.

If the adhesive strength of the adhesive surface of strips 12 and 14 is less than five ounces per inch of width, then the notepad 10 will only adhere for a very brief length of time to the surface of the checkbook cover 30. However, if the adhesive strength is greater than eighty-five ounces per inch of width, then the adhesion to the checkbook cover will be too strong. As a result, when the notepad 10 is removed, it will leave marks on the inner surface of the checkbook cover 30. Also, if removal is attempted, then the paper will tear and remain attached to the checkbook cover. As such, after experimentation, it was found that the preferred embodiment is somewhere between these two limits. Ideally, after experimentation, it was found that an adhesive with a strength of fifteen ounces per inch of width can be removed without leaving unnecessary marks or causing the paper of the notepad 10 to tear. Also, the notepad will remain affixed in the desired position on the interior of the checkbook cover.

Figure 3:
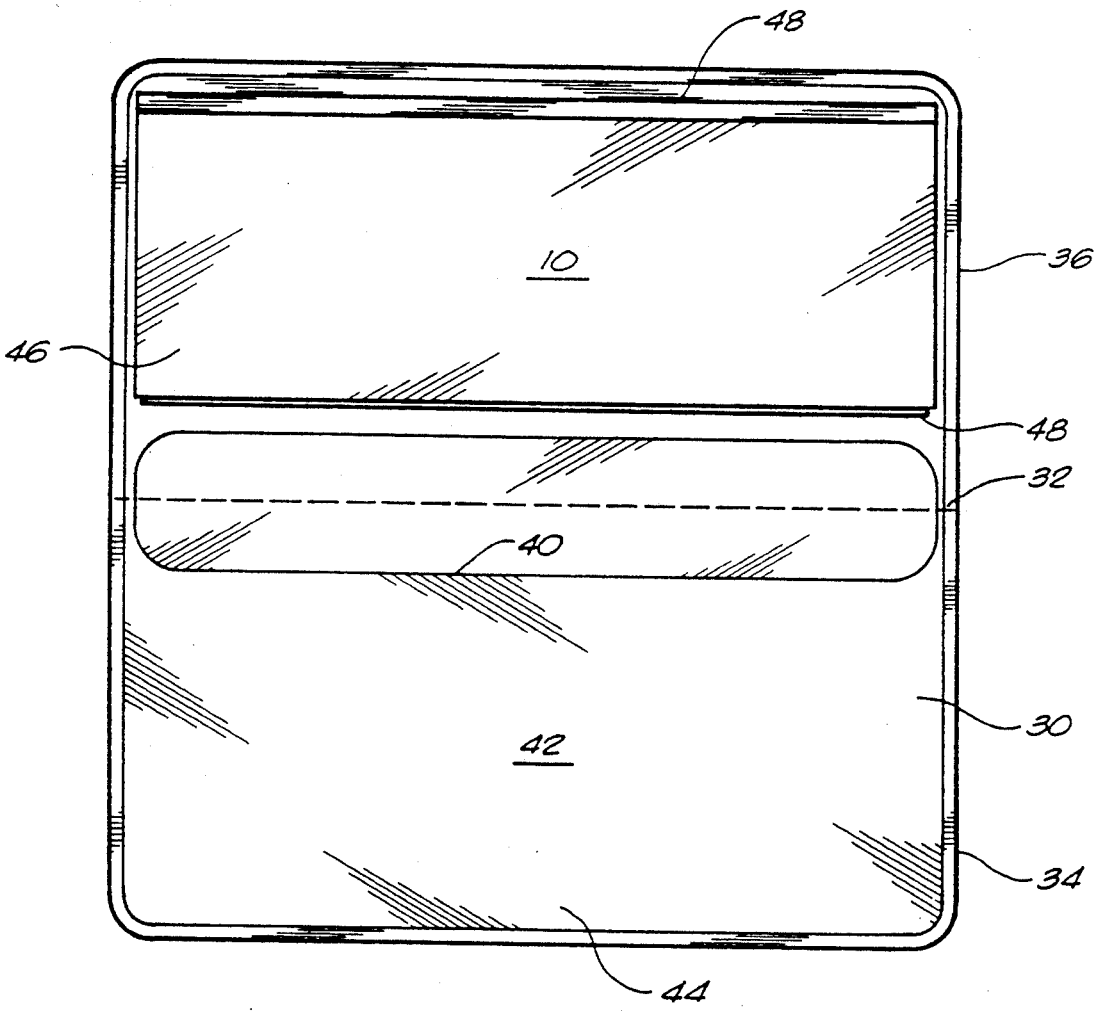
FIG. 3 is a full view in side elevation showing the notepad as affixed within the area of the checkbook cover.

Referring to FIG. 3, the appearance of the checkbook cover 30 can be seen. In particular, it can be seen that the first section 34 and the second section 36 can be folded along fold line S2. A slot 40 is provided in the first section 34 so as to receive the back cover of a checkbook. The checkbook will reside in area 32 on the first section 34. A plastic liner 44 may be provided along the inner surface of the checkbook cover 30. As can be seen the checkbook: cover 30 has a generally rectangular configuration. The notepad 10 is affixed to the inner surface of the second section 36 of checkbook cover 30. A first sheet 46 is provided in a proper position for use by the user of the checkbook 30. All of the sheets 46 are connected along a common edge 48. After the first sheet 46 is used, the sheet 46 can be removed so as to expose the second sheet 48 therebelow. Such a process continues until the notepad 10 is used up. After the notepad 10 is used up, the entire notepad 10 can be removed by peeling the backing surface, and the adhesive strips, from the inner surface of the checkbook cover 30. It can also be seen that the notepad 10 has an area that is less than half of the total surface area of the checkbook cover 30. In this configuration, the first second 34 and the second section 36 of checkbook cover 30 can be folded onto itself so as to cover the exposed portions of the notepad 10. When folded, the notepad 10 and a checkbook contained in slot 40 on surface 42 will be in face-to-face relationship.

Figure 4:
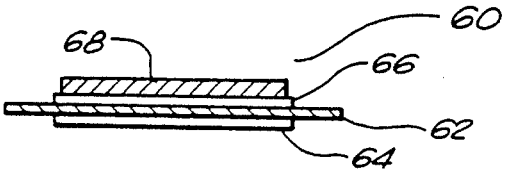
FIG. 4 is greatly enlarged end view showing the a configuration of a single adhesive strip.

FIG. 4 shows a side view, in greatly enlarged proportion, of a single adhesive strip 60. It can be seen that the adhesive strip 60 has a central plastic strip 62. Adhesive layers 64 and 66 are applied to each side of the plastic strip 62. The adhesive layer 64 will be positioned and permanently fastened to the backing surface 18 of the notepad 10. Since the purpose of the adhesive layer 64 is to permanently, affix the adhesive strip 60 to the backing surface 18 of the notepad 10, the adhesive layer 64 may have an adhesive strength within the limits described herein previously or an adhesive strength of greater than 85 ounces per inch of width. The purpose of the adhesive layer 64 is to cause the adhesive strip 60 to be permanently fastened to the backing surface of the notepad 10.

The adhesive layer 66 is applied to the opposite side of the plastic strip 62. The adhesive layer 66 has the strength and the qualities described herein previously. The purpose of the adhesive layer 66 is to removably fasten the notepad 10 to the plasticized cover of the checkbook. As such, it is important that the adhesive layer 66 have the adhesive properties described herein previously. A thin piece of silicon-coated paper 68 is temporarily placed on the adhesive layer 66 on the side opposite to the plastic strip 62 The paper strip 68 is silicon coated so that it weakly adheres to the adhesive 66. The paper 68 serves to protect the adhesive 66 prior to the application of the notepad to the checkbook cover.

When it is desired to affix the notepad 10 to the checkbook 30, as shown in FIG. 3, then the paper strip 68 is removed from the adhesive 66. This will allow the adhesive strip 60 to properly adhere to the checkbook cover 30.

The present invention offers an improved notepad for checkbooks that allows the notepad to be easily attached to the inner surface of a checkbook cover. The notepad is of a relatively inexpensive configuration. The proper selection of the adhesive used for the fastening of the notepad to the checkbook cover is an important consideration. The adhesive selected, for the present invention, allows the notepad 10 to be attached to the inner surface of the checkbook cover without permanently adhering to the checkbook cover. On the other hand, the adhesive allows the notepad to be securely received and maintained in position on the checkbook cover during its life of use. The notepad can be used universally with many types of covers. It can be positioned quickly and easily without undue manipulation.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A notepad for checkbooks comprising:

a plurality of sheets affixed together along a common edge;

a backing surface connected to said plurality of sheets, said backing surface having a front side and a back side, said plurality of sheets adjacent said front side; and an adhesive strip fastened to the back side of said backing surface, said adhesive strip having an adhesive surface on one side opposite said backing surface, said adhesive strip having an adhesive strength of between 5 ounces per inch of width and 85 ounces per inch of width.

2. The notepad of claim 1, said adhesive strip extending longitudinally along said backing surface.

3. The notepad of claim 2, further comprising:

a second adhesive strip fastened to another location on said backing surface.

4. The notepad of claim 3, said second adhesive strip having an adhesive strength equal to that of said first adhesive strip.

5. The notepad of claim 4, said second adhesive strip extending parallel to said first adhesive strip, said second adhesive strip extending longitudinally along said backing surface.

6. The notepad of claim 1, said adhesive strength being approximately fifteen ounces per inch of width.

7. The notepad of claim 1, said adhesive strip having an adhesive coating on one side of greater strength than the adhesive coating on another side.

8. The notepad of claim 1, said adhesive strip having a paper strip removably attached to an adhesive coating of said adhesive strip.

9. The notepad of claim 1, said adhesive strip being adhesively fastened to said backing surface.

10. An apparatus comprising:

a cover of a flexible foldable plasticized material:

a plurality of sheets affixed together along a common edge;

a backing surface connected to said plurality of sheets, said backing surface having a front side and a back side, said plurality of sheets adjacent said front side; and an adhesive strip fastened to said backing surface and to said cover, said adhesive strip having an adhesive surface fastened to said cover, said adhesive surface of said adhesive strip having an adhesive strength of between five ounces per inch of width and eight-five ounces per inch of width.

11. The apparatus of claim 10, said cover being a polyvinyl chloride material having a plasticizer contained therein.

12. The apparatus of claim 10, said adhesive strip adhesively fastened to an inner surface of said cover.

13. The apparatus of claim 10, said backing surface having an area less than one-half of the area of said cover.

14. The apparatus of claim 13, said cover foldable over the entire exterior surface of said plurality of sheets.

15. The apparatus of claim 10, further comprising:

a second adhesive strip fastened to another location on the back side of said backing surface and fastened to said cover.

16. The apparatus of claim 15, said second adhesive strip having an adhesive strength equal to that of said first adhesive strip.

17. The apparatus of claim 16, said second adhesive strip extending parallel to said first adhesive strip, said second adhesive strip extending longitudinally along said backing surface.

18. The apparatus of claim 10, said adhesive strength being approximately fifteen ounces per inch of width.

19. The apparatus of claim 10, said adhesive strip having a first adhesive coating on one side and a second adhesive coating on another side, said first adhesive coating for attaching said adhesive strip to said backing surface, said first adhesive coating having a greater adhesive strength than said second adhesive coating

20. The apparatus of claim 19, said adhesive strip having a silicon-coated paper removably covering said second adhesive coating.

* * * * *